US005430530A

United States Patent [19]

Ott et al.

[11] Patent Number: 5,430,530

[45] Date of Patent: Jul. 4, 1995

[54] ADMIX HOUSING

[75] Inventors: Mary L. Ott; Ted O. Becker, both of Fairport, N.Y.

[73] Assignee: Xerox Corporation, Stamford, Conn.

[21] Appl. No.: 131,230

[22] Filed: Oct. 4, 1993

[51] Int. Cl.[6] ..... G03G 15/08

[52] U.S. Cl. ..... 355/260; 355/298; 355/246

[58] Field of Search ..... 355/260, 245, 247, 253, 355/298, 246; 118/653-658; 222/DIG. 1

[56] References Cited

U.S. PATENT DOCUMENTS

| | | | |
|---|---|---|---|
| 3,635,553 | 1/1972 | Adamek et al. . | |
| 3,697,050 | 10/1972 | Stanley . | |
| 3,882,823 | 5/1975 | Tanaka et al. . | |
| 4,033,294 | 7/1977 | Charland et al. | 118/658 |
| 4,133,458 | 1/1979 | Budny | 222/228 |
| 4,142,655 | 3/1979 | Fantuzzo | 222/318 |
| 4,173,405 | 11/1979 | Swapceinski et al. . | |
| 4,478,512 | 10/1984 | Zoltner . | |
| 4,570,570 | 2/1986 | Masham | 118/612 |
| 4,614,165 | 9/1986 | Folkins et al. | 118/657 |
| 4,707,107 | 11/1987 | Joseph . | |
| 4,926,790 | 5/1990 | Nash | 118/653 |
| 5,260,748 | 11/1993 | Kahle | 355/253 |
| 5,260,750 | 11/1993 | Ishida et al. | 355/260 |
| 5,289,241 | 2/1994 | Sugiyama et al. | 355/260 |

*Primary Examiner*—R. L. Moses
*Attorney, Agent, or Firm*—John S. Wagley

[57] ABSTRACT

A mixing apparatus adapted to receive toner particles from a toner container and carrier granules from a developer unit. The mixing apparatus comprises a housing defining a chamber for receiving the toner particles and carrier granules and a mixer, disposed in the chamber of the housing, to mix the carrier granules and toner particles with one another. The mixing apparatus further comprises a discharger for discharging toner particles and carrier granules from the chamber of the housing to the developer unit.

31 Claims, 5 Drawing Sheets

ADMIX HOUSING

The present invention relates to a method and apparatus for applying toner to a developer housing. More specifically, the invention relates to a separate admix housing for admixing the toner prior to delivery to the developer.

The features of the present invention are useful in the printing arts and more particularly in electrophotographic printing. In the process of electrophotographic printing, a photoconductive surface is charged to a substantially uniform potential. The photoconductive surface is image wise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image in a region known as the development zone. Toner particles are attracted from beads of the developer material onto the latent image. The resultant toner powder image is then transferred from the photoconductive surface to a copy sheet and permanently affixed thereto. The foregoing generally describes a typical mono-color electrophotographic copying machine.

Since toner particles while the printer is printing are continually removed from the beads of the developer material, these toner particles must be replenished. This replenishment is accomplished by toner from a toner dispenser being admixed with the carrier to form developer. Admixing the toner and the carrier is an essential part of a two component development system. Typically the toner and the carrier are admixed in the development housing. Toner is added to the development housing and a mixer aids in the admixing. When running printers for extended times, toner must be added during copying, and as such, the portion of the toner just added in the development housing has not been adequately mixed with carrier to form proper triboelectrical characteristics that are essential for the proper attraction of toner particles onto the latent image. Many additives have been discovered that improve the speed in which the mixing of toner and developer forms proper triboelectrical characteristics in the developer. The proper blend of additives to obtain optimum characteristics can involve very time consuming development. Further, several of these additives are alleged to be environmentally undesirable. This invention is directed to addressing these difficulties.

The following disclosures may be relevant to various aspects of the present invention:

U.S. Pat. No. 4,926,790 Patentee: Nash Issue Date: May 22, 1990

U.S. Pat. No. 4,707,107 Patentee: Joseph Issue Date: Nov. 17, 1987

U.S. Pat. No. 4,614,165 Patentee: Folkins, et al. Issue Date: Sep. 30, 1986

U.S. Pat. No. 4,570,570 Patentee: Masham Issue Date: Feb. 18, 1986

U.S. Pat. No. 4,142,655 Patentee: Fantuzzo Issue Date: Mar. 6, 1979

U.S. Pat. No. 4,033,294 Patentee: Charland, et al. Issue Date: Jul. 5, 1977

U.S. Pat. No. 3,882,823 Patentee: Tanaka et al. Issue Date: May 13, 1975

U.S. Pat. No. 3,697,050 Patentee: Stanley Issue Date: Oct. 10, 1972

U.S. Pat. No. 3,635,553 Patentee: Adamek et al. Issue Date: Jan. 18, 1972

U.S. Pat. No. 4,926,790 discloses an apparatus which mixes and transports developer material in the chamber of a development housing. An auger advances a portion of the developer material from one end to the other of the housing. The auger has an expansion chamber extending over a portion of the chamber through which at least a portion of the developer material flows.

U.S. Pat. No. 4,707,107 discloses an electrographic development apparatus which has a sump for receiving developer material including carrier particles and toner particles. A ribbon blender in the sump mixes the toner particles and the carrier particles, circulates them within the sump and assists in transporting the materials to a magnetic brush.

U.S. Pat. No. 4,614,165 discloses an apparatus which develops an electrostatic latent image recorded on a photoconductive member employed in a electrophotographic printing machine. The apparatus employs a developer material which ages during the life of the machine. A continuous supply of carrier granules is furnished to the developer material.

U.S. Pat. No. 4,570,570 discloses an apparatus in which flowing developer material is mixed. A plurality of spaced vanes project outwardly from a dividing plate to define a plurality of sets of chambers arranged in substantially parallel rows. Each chamber is arranged to receive developer material from an exit aperture.

U.S. Pat. No. 4,142,655 discloses a dispensing hopper adjacent a photoreceptor drum with a first reservoir with a first opening through which material is dispensed into a sump. The dispensing hopper also has a second reservoir with an opening through which excess material is returned to the hopper. A remote toner container is coupled to the first and second reservoirs of the hopper by flexible augers.

U.S. Pat. No. 4,033,294 discloses a magnetic brush developing apparatus having magnetic rollers with end sleeves forming an insulating material. A trimming bar is provided having a concave portion below a leading edge thereof to facilitate the return to the sump zone of excess developing material. Magnets disposed within the rollers are mounted on the channel members to direct development material.

U.S. Pat. No. 3,882,823 discloses a stirring and scraping device for developing material for use in an electrophotographic copying apparatus which comprises a rotary member rotatably provided below a toner dispenser and adjacent to a rotary developing roller in which stationary magnets are enclosed.

U.S. Pat. No. 3,697,050 discloses a cross-mixing device which is arranged in the flow stream of electrostatic developing material for mixing the material as it flows therethrough. The device is formed with a plurality of deflection elements which effect some of the material.

U.S. Pat. No. 3,635,553 discloses an apparatus for raising developer from a sump to an elevated position over an electrostatic plate bearing a latent image and cascading the developer over the plate to develop the image including a rotating frame having scoops fastened thereto which are filled with developer as they pass through the sump and empty the developer into a guide member which directs the developer over the plate.

In accordance with one aspect of the present invention, there is provided a mixing apparatus adapted to receive toner particles from a toner container and carrier granules from a developer unit. The mixing apparatus comprises a housing defining a chamber for receiving the toner particles and carrier granules and a mixer, disposed in the chamber of the housing, to mix the carrier granules and toner particles with one another. The mixing apparatus further comprises means for discharging toner particles and carrier granules from the chamber of the housing to the developer unit.

In accordance with another aspect of the present invention, there is provided a method for mixing toner particles with carrier granules comprising the steps of discharging toner particles from a toner container into a mixing housing, transporting carrier granules from a developer unit to the mixing housing, mixing the toner particles and the carrier granules in the mixing housing with one another, and dispensing mixed toner particles and carrier granules from the mixing housing to the developer unit.

In accordance with a further aspect of the present invention, there is provided a developer unit for for developing a latent image recorded on an image receiving member to form a developed image. The developer unit comprises a developer housing defining a chamber for storing developer material comprising carrier granules and toner particles, a toner dispenser for discharging toner particles, and a housing defining a chamber coupled to the developer housing and the toner dispenser for receiving carrier granules and toner particles. The developer unit further comprises a mixer, disposed in the chamber of the housing, to mix the carrier granules and toner particles with one another; and means for discharging toner particles and carrier granules from the housing to the developer housing.

In accordance with yet another aspect of the present invention, there is provided a printing machine comprising a photoconductive member, means for recording an electrostatic latent image on the photoconductive member, and a developer unit adapted to develop the latent image recorded in the photoconductive member with the toner particles. The developer unit includes a developer housing defining a chamber for storing developer comprising carrier granules and toner particles. The developer unit also includes a toner dispenser for discharging toner particles and a housing defining a chamber coupled to the developer housing and the toner dispenser for receiving carrier granules and toner particles. The developer unit further includes a mixer, disposed in the chamber of the housing, to mix the carrier granules and toner particles with one another, and means for discharging toner particles and carrier granules from the housing to the developer housing.

The invention will be described in detail herein with reference to the following figures in which like reference numerals denote like elements and wherein:

BRIEF DESCRIPTION OF THE DRAWINGS

For a general understanding of the illustrative electrophotographic printing machine incorporating the features of the present invention therein, reference is made to the drawings. In the drawings, like reference numerals have been used throughout to designate identical elements. FIG. 5 schematically depicts the various components of an electrophotographic printing machine incorporating the admix housing of the present invention therein. Although the admix housings of the present invention are particularly well adapted for use in the illustrative printing machine, it will become evident that these admix housings are equally well suited for use in a wide variety of printing machines and are not necessarily limited in their application to the particular embodiments shown herein.

Referring now to FIG. 5, the electrophotographic printing machine employs a belt 16, i.e., a charge retentive member, having a photoconductive surface deposited on a conductive substrate. Belt 16 moves in the direction of arrow 18 to advance successive portions thereof sequentially through the various processing stations disposed about the path of movement thereof. Belt 16 is entrained about drive roller 22, tensioning roller 20 and stripping roller 24. Motor 26 rotates roller 22 to advance belt 16 in the direction of arrow 18. Roller 22 is coupled to motor 26 by suitable means such as a belt drive.

Figure 1:
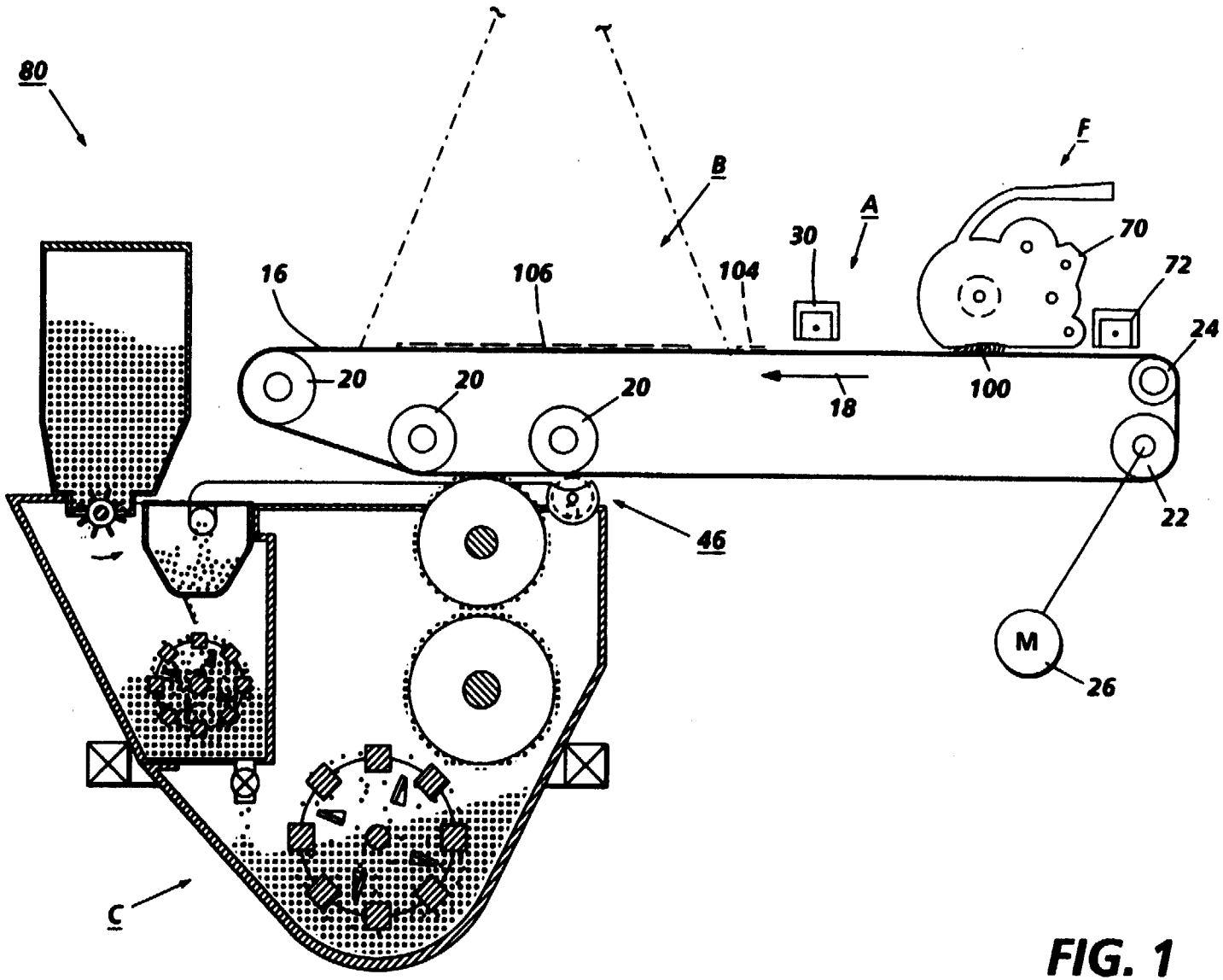
FIG. 1 is a schematic elevational view of portions of an illustrative electrophotographic printing machine incorporating the admix housing of the present invention therein.

Initially successive portions of belt 16 pass through charging station A. At charging station A, a corona generating device, indicated generally by the reference numeral 30, charges the belt 16 to a selectively high uniform electrical potential, preferably negative. Any suitable control, well known in the art, may be employed for controlling the corona generating device 30.

Next, the charged portions of the photoconductive surface are advanced through exposure station B. At exposure station B, the uniformly charged photoconductive surface or charge retentive surface is exposed to a laser based raster output scanning device 32 which causes the charge retentive surface to be selectively discharged in accordance with the output from the scanning device 32. Preferably, the scanning device is a three level laser Raster Output Scanner (ROS). The output scanning device 32 is driven by an input signal from an electronic subsystem (ESS) 34, which would serve as the interface between the device 32 and an input signal generator (not shown). Thus, in this embodiment, the photoconductive surface, which is initially charged to a high charge potential, is discharged image wise in the background (white) image areas and to near zero or ground potential in the highlight (i.e. color other than black) color parts of the image.

At development station C, a magnetic development system, indicated generally by the reference numeral 36 advances developer materials into contact with the electrostatic latent images. Preferably, the magnetic developer unit includes a magnetic developer roller 40 mounted in a housing. Thus, developer unit 36 contains a magnetic roller 40. The roller 40 advances developer material into contact with the latent image. Appropriate developer biasing may be accomplished via power supply 42, electrically connected to developer unit 36.

The developer unit 36, in the direction of movement of belt 16 as indicated by arrow 18, develops the charged image areas of the photoconductive surface. This developer unit contains black developer, for example, material 44 having a triboelectric charge such that the black toner is urged towards charged areas of the latent image by the electrostatic field existing between the photoconductive surface and the electrically biased developer rolls in the developer unit which are connected to the bias power supply 42. Further, the unit 36 has a bead removal device 46 disposed therein.

A sheet of support material 58 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute which directs the advancing sheet of support material into contact with the photoconductive surface of belt 16 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the toner powder image from the belt 16 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator. It will also be understood that other post-fusing operations can be included, for example, binding, inverting and returning the sheet for duplexing and the like.

After the sheet of support material is separated from the photoconductive surface of belt 16, the residual toner particles carried by image and the non-image areas on the photoconductive surface are charged to a suitable polarity and level by a preclean charging device 72 to enable removal therefrom. These particles are removed at cleaning station F. The vacuum assisted, electrostatic, fur brush cleaner unit 70 is disposed at the cleaner station F. The cleaner unit has two fur brush rolls that rotate at relatively high speeds which creates mechanical forces that tend to sweep the residual toner particles into an air stream (provided by a vacuum source), and then into a waste container. Subsequent to cleaning, a discharge lamp or corona generating device (not shown) dissipates any residual electrostatic charge remaining prior to the charging thereof for the next successive imaging cycle.

It is believed that the foregoing description is sufficient for purposes of the present application to illustrate the general operation of an electrophotographic printing machine incorporating the development apparatus of the present invention therein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 5:
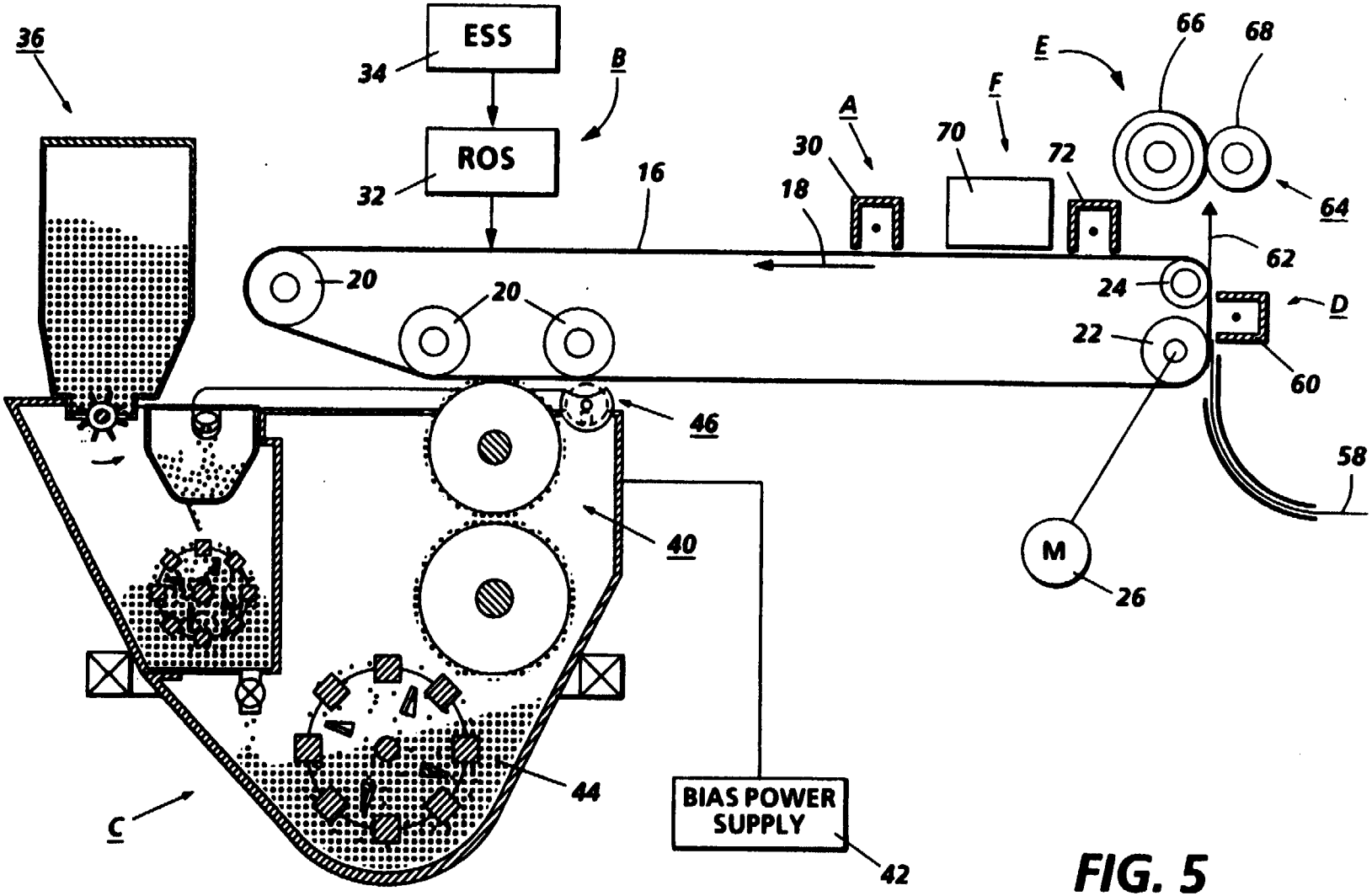
FIG. 5 is a schematic elevational view of an illustrative electrophotographic printing machine incorporating the admix housing of the present invention therein.

A copy or printing machine 80 incorporating the features of the subject invention is generally shown in FIG. 1. The machine as shown shows the image receiving member 16 in the form of a photoreceptor belt. It should be appreciated, however, that the invention may be practiced equally as well wherein the image receiving member is a photoreceptor drum or any other suitable configuration. As shown in FIG. 1, the photoreceptor belt rotates in the direction of arrow 18 in a counter-clockwise direction. It is readily apparent that the direction of rotation of the photoreceptor belt might be reversed provided the other portions of the machine were likewise reversed. The photoreceptor belt 16 is driven by drive pulley 22 which is powered by motor 26. The series of other pulleys 20 serve to direct the photoreceptor belt 16 through the different stations of the machine. The general operation of the charging, exposure, development, transfer, fusing, and cleaner stations, A–F, respectively, for the copying or printing machine 80 is similar to that of the stations A–F as shown in FIG. 5. Only the cleaning station F, the charging station A, the exposure station B, and the development station C are shown in detail in FIG. 1.

The photoreceptor belt 16 after it passes by drive pulley 22 proceeds to the first of several pulleys 20. From the first of pulleys 20, the photoreceptor belt 16 passes by precleaning corona 72, which may be a corotron, dicorotron, or similar corona generating device. The precleaning corona device 72 serves to remove remaining electrostatic charges from the belt 16. Next, the photoreceptor belt 16 passes by cleaning unit 70. The cleaning unit 70 may take on any suitable form but typically includes a brush 100 which physically contacts the photoreceptor belt 16 removing all remaining particles from the photoreceptor belt 16. The precleaning corona 72 and cleaning unit 70 serve to form the cleaning station F. After the photoreceptor belt 16 passes the cleaning station F, it enters charging station A. Charging station A includes one or more charging coronas 30 which places an electrostatic charge 104 on the photoreceptor belt 16. From the charging station A, the photoreceptor belt 16 passes onto exposure station 13. The exposure station B exposes light to portions of the photoreceptor belt 16, thereby creating a latent image 106 on the photoreceptor belt 16. The exposure of the belt 16 may be either optically, as in a copy machine, or digitally, as used in a printing machine. For digital exposure an electronic subsystem and a raster output scanning device such as items 27 and 25, respectively, as shown in FIG. 5 are used. The latent image 106 progresses from the exposure station B onto development station C.

Figure 2:
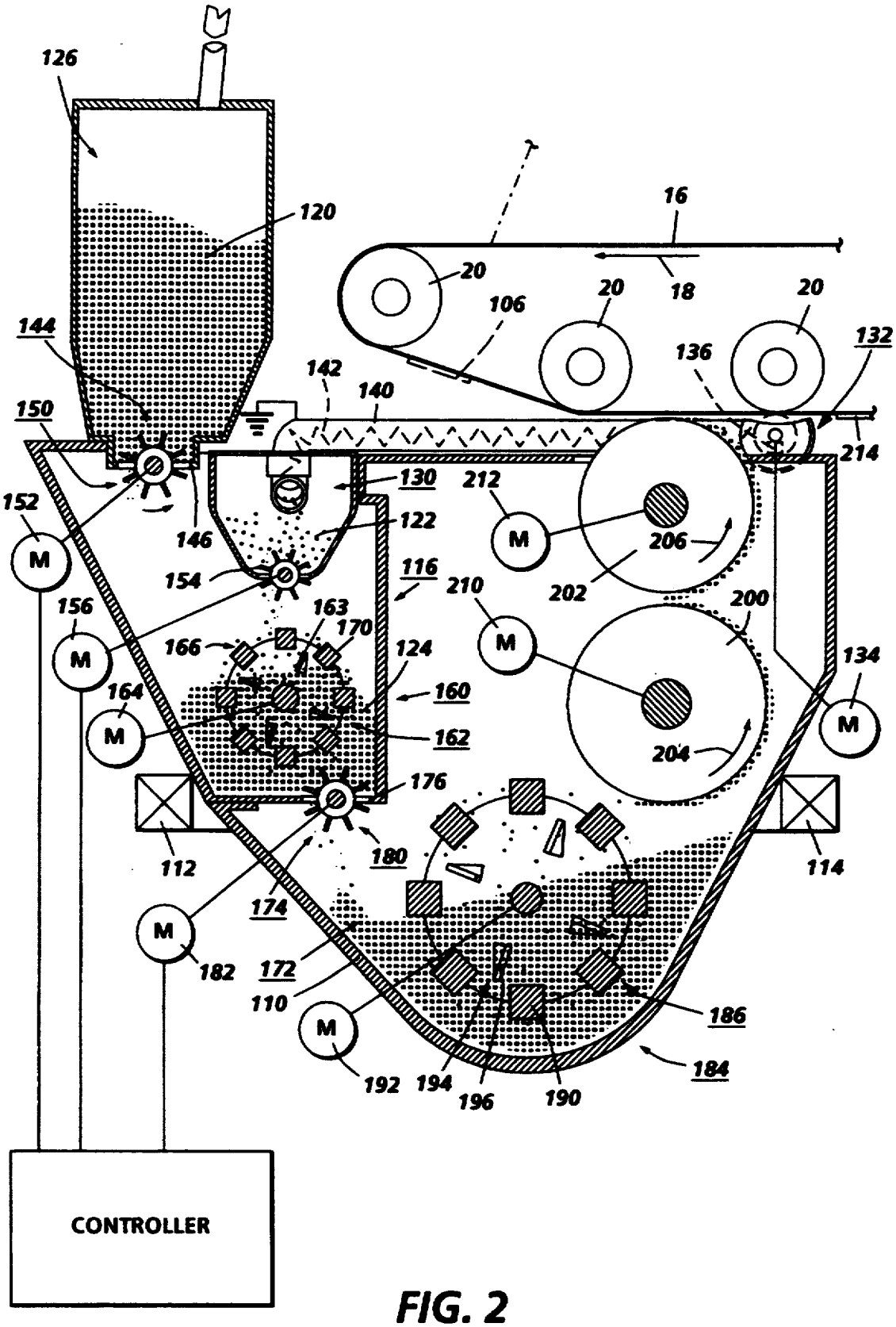
FIG. 2 is a partial schematic elevational view of the admix housing of FIG. 1.

The developing station C is shown generally in FIG. 2. The position and configuration of the individual components of the development system are shown for illustrative purposes only and it should be appreciated that the shape, location, and configuration of these particular components will vary based upon the individual needs of the relevant copying or printing machine. The developing station C includes a developing housing 110. The developing housing 110 is connected to and supported by the copying or printing machine (as shown in FIG. 1). For example, the developing housing 110 may be supported by left and right developer housing supports 112 and 114, respectively. The development station further includes a mixing compartment 116. The mixing compartment 116 may either be a portion of the developer housing 110 as shown in FIG. 2, or the mixing compartment 116 may be located in a separate housing adjoining or separated from the development housing 110.

In a xerographic process using two component development, toner particles 120 triboelectrically mix with carrier granules 122 to form developer 124.

The development station further includes a toner particle storage area 126. The toner particle storage area 126 may take on any suitable form, such as an integral compartment of the developer housing 110, a separate container adjacent the developer housing 110, as shown in FIG. 2, or in the form of a separate container spaced from the developer housing 110. The toner particle container may have any suitable configuration such as a bottle, hopper or a cartridge. The development station C further includes a carrier particle storage area 130 which may be in the form of a separate hopper adjoining the development housing 110, as shown in FIG. 2, or as a separate compartment of the developer housing 110 or as a separate container located away from developer housing 110. The carrier particle storage area 130 may take on any suitable shape such as a hopper, as shown in FIG. 2, a bottle or a cartridge.

Toner particles 120 are added to the toner particle storage area 126 by either replacing an empty toner bottle 126 as illustrated in the bottle of FIG. 1, or by adding toner particles 120 to the toner hopper 126 through the tube shown in FIG. 2. Carrier granules 122 are added to the carrier hopper 130 by removing carrier granules 122 from the image receiving member 16. A carrier bead removal device 132 located adjacent the image receiving member 16 is used to remove carrier granules 122 from the latent image 106. The carrier bead removal device 132 may take on any suitable form but preferably is in the form of a drum which rotates by means of motor 134. The carrier bead removal device typically includes a magnet 136 located within the drum which picks the magnetic carrier granules 122 from the image receiving member 16. A carrier conveyor 140 is located between the carrier bead removal device 132 and the carrier hopper 130 and is used to transport the carrier granules 122 from the bead removal device 132 to the carrier hopper 130. The carrier conveyor 140 may take on any suitable configuration such as a tube having a flexible auger 142 therewithin.

Toner particles 120 located in the toner hopper 126 combine with carrier granules 122 located within the carrier hopper 130 and are mixed in the mixing compartment 116. Preferably, to control the quantity of toner particles 120 to be mixed, the toner hopper 126 includes a toner meter 144 typically located in the bottom 146 of the toner hopper 126. The toner meter 144 may take on any suitable form, such as a toner paddle wheel having paddles 150 and being driven by a motor 152. A small portion of toner particles 120 is collected between adjoining paddles 150 and permitted to leave the toner hopper 126. To control the quantity of carrier granules 122 which are added to the mixing compartment 116, the carrier hopper 130 includes a carrier meter 154 which may take any suitable form such as a carrier paddle wheel as shown in FIG. 2. Motor 156 may be used to rotate the carrier paddle wheel 154 similarly to toner paddle wheel 144.

The toner particles 120 and the carrier granules 122 are mixed in the mixing compartment 116. Preferably, the mixing of the carrier granules 122 and the toner particles 120 is augmented by the use of a mixing stirrer 160. The mixing stirrer 160 may have any suitable form and configuration and may include a mechanical stirrer 162 which has blades 163 and is propelled by a motor 164. The mixing stirrer 160 may likewise include a magnetic stirrer 166 which includes magnets 170 and is likewise propelled by a motor such as motor 164.

After the carrier granules 122 and the toner particles 120 have been stirred sufficiently within the mixing compartment 116 to form the developer particles 124, the developer particles 124 are released to sump 172 within the developer housing 110. Preferably, to control the quantity of developer particles 124 leaving the mixing chamber 116, a developer meter 174 is located at bottom 176 of the mixing compartment 116. The developer meter 174 may take on any suitable form such as a gate valve or a developer paddle wheel having paddles 180 driven by motor 182 as shown in FIG. 2. To insure the thorough mixing of the developer particles 124, the sump 172 further includes a sump stirrer 184. The sump stirrer 184 may assume any suitable form, such as a magnetic stirrer 186 which includes a series of magnets 190 and is driven by motor 192. The sump stirrer 184 may likewise include mechanical stirrer 194 which includes blades 196 which may also be driven by motor 192.

Developer particles 124 are transferred from the sump 172 to the image receiving member 16 by any suitable means such as by a developer roll or lower and upper developer rolls 200 and 202, respectively. The rolls 200 and 202 may include a magnetic outer surface, a series of bristles or other means to transfer the developer 124 upwardly. The lower and upper developer rolls 200 and 202, respectively, may be rotated in the direction of arrows 204 and 206, respectively, by motors 210 and 212, respectively. As shown in FIG. 2, the developer particles 124 progress from the sump 172, upwardly along the periphery of the lower and upper developer rolls 200 and 202, and are transferred onto latent image 106 thereby providing developed image 214.

A controller as shown in FIG. 2 may be electrically connected to motors 152, 156 and 182, which control the toner paddle wheel 144, the carrier paddle wheel 154, and the developer paddle wheel 174, respectively. The controller may serve to control the operation of the motors 152, 156 and 182, which may be positioning motors which may rotate a prescribed amount thereby rotating the respective paddle wheels 144, 154, 174 a specified amount. Thus the controller may permit only the proper amount of carrier granules 122 to be combined with the toner particles 120 to form developer 124 and only a proper amount of developer 124 to enter the developer sump 172.

Figure 3:
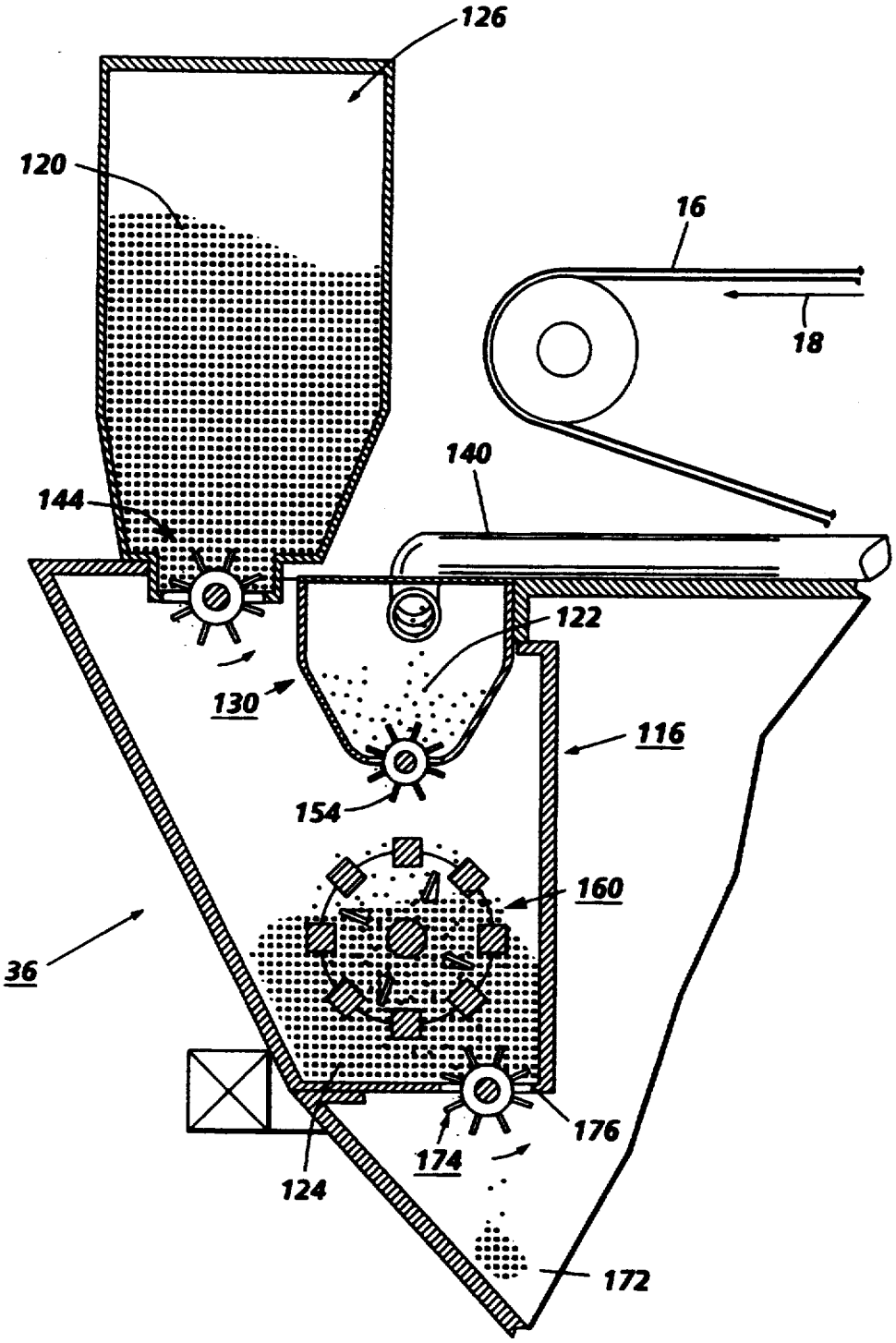
FIG. 3 is another partial schematic elevational view of the admix housing of FIG. 1.

Referring to FIG. 3, while the invention may be practiced utilizing any quantities of toner particles 126 and carrier granules 122 necessary when mixed in mixing compartment 116 to form the required amount of developer particles 124 to properly develop the latent image 106 into the developed image 214, an example of quantities of toner particles 126 and carrier granules 122 forming developer particles 124 will be illustratively described henceforth. Applicants have found that most toner compounds have admix times less than two minutes and, as such, quantities of toner and carrier and sequencing will be so arranged to describe admixing within a period of two minutes. Applicants have found that an average xerographic copy made from a xerographic copy machine utilizes approximately 30 milligrams of toner. For a high volume copy machine producing 135 copies per minute, this use equates to 4 grams of toner used per minute of copy machine operation. For the purposes of this example, the developer consists of 3% by weight of toner 120 and 97% by weight of carrier 122. For this example at time=0, 177 grams of toner are located in toner hopper 126 and 5,723 grams of carrier 122 are located in the carrier hopper 130. Toner paddle wheel 144 is then rotated to drop 8 grams of toner 120 into mixing compartment 116. Carrier paddle wheel 154 is simultaneously rotated to permit 259 grams of carrier to be dropped into mixing compartment 116. Mixing stirrer 160 then rotates and mixes the toner 120 and the carrier 122 to form developer 124. At time=2 minutes, the developer 124 is fully mixed. At that time, the developer paddle wheel 174 is rotated permitting the developer 124 to fall into the sump 172. At this point, the procedure may be repeated as many times as necessary, i.e., at T=slightly greater than 2 minutes, the second supply of toner 120 and carrier 122 is mixed in the mixing compartment 116 and, at T=slightly greater than 4 minutes, the third batch of toner 120 and carrier 122 is mixed in the mixing compartment 116.

Figure 4:
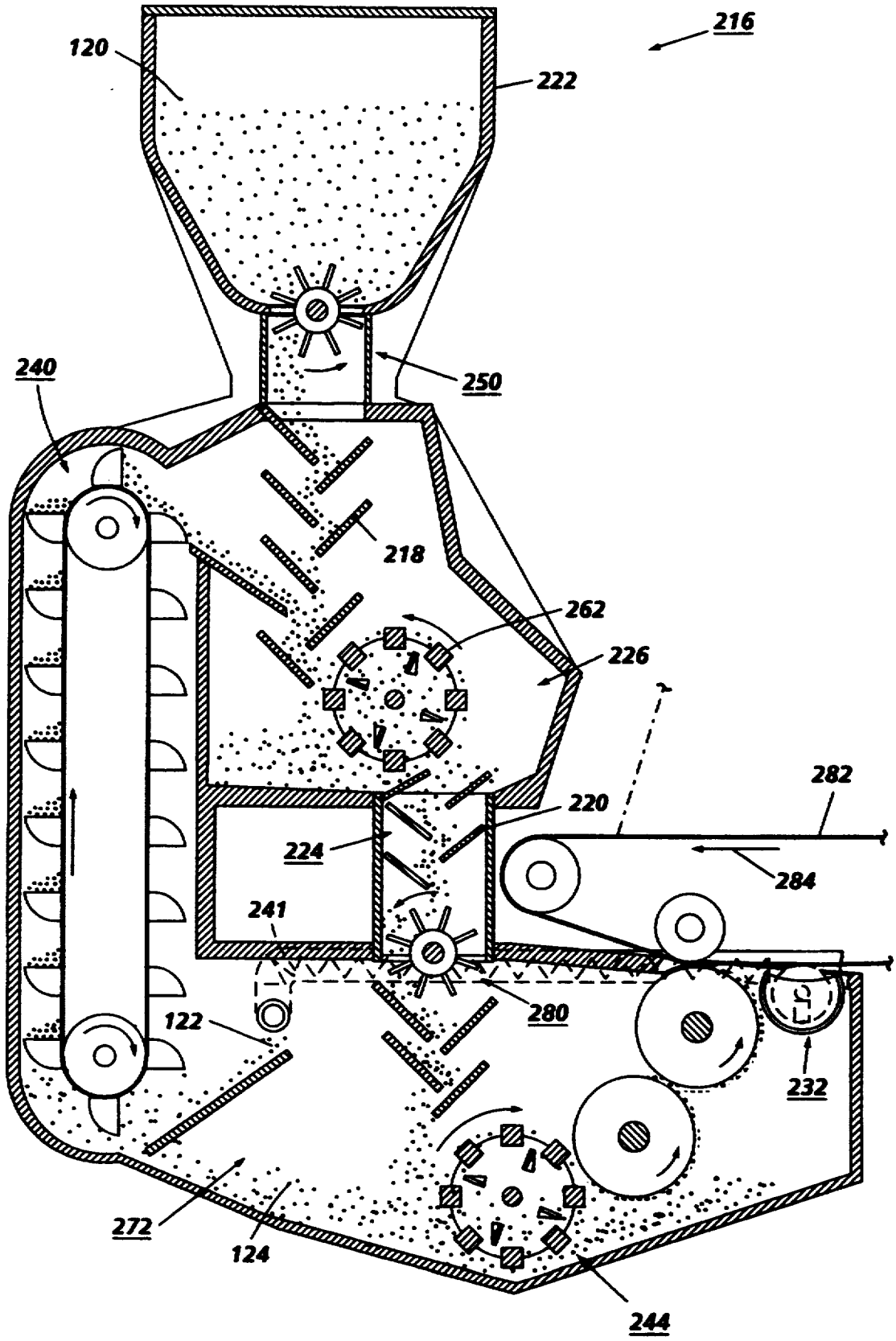
FIG. 4 is a schematic elevational view of an alternate design of an admix housing of the present invention.

While the development station as shown in FIGS. 2 and 3 describe an embodiment of the subject invention which utilizes batch mixing of the toner 120 and the carrier 122, the invention may also be practiced utilizing continual mixing of carrier 122 and toner 120. For example, referring to FIG. 4, development system 200 may be provided. System 200 may include a developer conveyor 240 which removes developer 124 from sump 272 and transports it to a mixing compartment 216. The conveyor may continuously operate or operate on an intermittent basis. Toner 120 located in toner hopper 222 is transferred to the mixing compartment 216 by means of toner paddle wheel 250. Developer 124 and toner 120 may preferably be partially premixed by means of upper baffles 210. Mixing stirrer 262 located in the mixing compartment 216 further mix the toner 120 and developer 124. The mixing compartment 216 may also include a lower ready compartment 214 with a set of lower baffles 212 located between the mixing compartment 216 and the ready compartment 214. A mixing paddle wheel 280 located at the bottom of the ready compartment 214 is used to control the movement of developer 124 from the ready compartment 214to the sump 272. Bead removal device 232 may be located near photoreceptive belt 282 to remove carrier granules 122 from the belt 282. The carrier granules 122 are then transported by carrier conveyor 241 to an area adjacent the developer conveyor 240 where they may join the developer 124 in the mixing compartment 216. To insure the thorough admixing of the developer 124, the sump 272 preferably includes sump stirrer 184. The development system 200 provides for the continual admixing of toner 120 and carrier 122 to form the developer 124. The invention may be practiced with either continual admixing as shown in FIG. 4 or with batch admixing as shown in FIGS. 1, 2 and 3.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A mixing apparatus adapted to receive toner particles from a toner container and carrier granules from a developer unit comprising:

a housing defining a chamber for receiving the toner particles and carrier granules;

a mixer, disposed in the chamber of said housing, to mix the carrier granules and toner particles with one another;

means for discharging toner particles and carrier granules from the chamber of said housing to the developer unit;

a carrier granule recovery device for recovering used carrier granules from a developed image, said carrier granules to be delivered to said housing; and a carrier granule storage area for storing said carrier granules from said recovery device for delivery to said housing.

2. A mixing apparatus according to claim 1, further comprising a carrier granule conveyor for conveying carrier granules from the recovery device to the carrier granules storage area.

3. A mixing apparatus apparatus according to claim 1, wherein the carrier granule conveyer comprises a flexible auger.

4. A mixing apparatus adapted to receive toner particles from a toner container and carrier granules from a developer unit comprising:

a housing defining a chamber for receiving the toner particles and carrier granules;

a mixer, disposed in the chamber of said housing, to mix the carrier granules and toner particles with one another;

means for discharging toner particles and carrier granules from the chamber of said housing to the developer unit; and a carrier granule storage area for storing said carrier granules prior to delivery to said housing.

5. A mixing apparatus according to claim 4, further comprising a carrier meter for controlling the carrier granules added to the housing.

6. A mixing apparatus adapted to receive toner particles from a toner container and carrier granules from a developer unit comprising:

a housing defining a chamber for receiving the toner particles and carrier granules;

a mixer, disposed in the chamber of said housing, to mix the carrier granules and toner particles with one another;

means for discharging toner particles and carrier granules from the chamber of said housing to the developer unit; and a carrier granule conveyor for conveying carrier granules from the recovery device to the carrier granules storage area.

7. A mixing apparatus adapted to receive toner particles from a toner container and carrier granules from a developer unit comprising:

a housing defining a chamber for receiving the toner particles and carrier granules;

a mixer, disposed in the chamber of said housing, to mix the carrier granules and toner particles with one another;

means for discharging toner particles and carrier granules from the chamber of said housing to the developer unit; and a mix meter for controlling the mixed carrier granules and toner particles added to the developer unit.

8. A mixing apparatus adapted to receive toner particles from a toner container and carrier granules from a developer unit comprising:

a housing defining a chamber for receiving the toner particles and carrier granules;

a mixer, disposed in the chamber of said housing, to mix the carrier granules and toner particles with one another;

means for discharging toner particles and carrier granules from the chamber of said housing to the developer unit; and a carrier granules and toner particles stirrer in the developer unit.

9. A mixing apparatus adapted to receive toner particles from a toner container and carrier granules from a developer unit comprising:

a housing defining a chamber for receiving the toner particles and carrier granules;

a mixer, disposed in the chamber of said housing, to mix the carrier granules and toner particles with one another;

means for discharging toner particles and carrier granules from the chamber of said housing to the developer unit;

a toner meter for controlling the toner particles added to the housing;

a carrier meter for controlling the carrier granules added to the housing;

a mix meter for controlling the mixed carrier granules and toner particles added to the developer unit; and a controller for controlling the interaction of the toner meter, the carrier meter, and the mix meter.

10. A method for mixing toner particles with carrier granules comprising the step of:

discharging toner particles from a toner container into a mixing housing;

transporting carrier granules from a developer unit to the mixing housing;

mixing the toner particles and the carrier granules in the mixing housing with one another; and dispensing mixed toner particles and carrier granules from the mixing housing to the developer unit, wherein the step of discharging toner particles comprises the steps of determining a required amount of toner particles to b added and discharging the required amount of toner particles into the mixing housing.

11. The method of claim 10, further comprising the step of storing the carrier granules in a carrier granule storage area.

12. A method for mixing toner particles with carrier granules comprising the steps of:

discharging toner particles from a toner container into a mixing housing;

transporting carrier granules from a developer unit to the mixing housing;

mixing the toner particles and the carrier granules in the mixing housing with one another; and dispensing mixed toner particles and carrier granules from the mixing housing to the developer unit, wherein the step of transporting the carrier granules comprises the steps of determining a required amount of carrier granules to be added and transporting the required amount of carrier granules to the mixing housing.

13. A method for mixing toner particles with carrier granules comprising the steps of:

discharging toner particles from a toner container into a mixing housing;

transporting carrier granules from a developer unit to the mixing housing;

mixing the toner particles and the carrier granules in the mixing housing with one another; and dispensing mixed toner particles and carrier granules from the mixing housing to the developer unit, wherein the step of dispensing mixed toner particles and carrier granules comprises the steps of determining a required amount of mixed toner particles and carrier granules to be added and dispensing the required amount of mixed toner particles and carrier granules to the developer unit.

14. A developer unit for developing a latent image recorded on an image receiving member to form a developed image, comprising;

a developer housing defining a chamber for storing developer material comprising carrier granules and toner particles;

a toner dispenser for discharging toner particles;

a housing defining a chamber coupled to said developer housing and said toner dispenser for receiving carrier granules and toner particles;

a mixer, disposed in the chamber of said housing, to mix the carrier granules and toner particles with one another;

means for discharging toner particles and carrier granules from said housing to said developer housing;

a carrier granules recovery device for recovering used carrier granules from the developed image, said carrier granules to be delivered to said housing for receiving carrier granules; and a carrier granule storage area for storing said carrier granules from said recovery device for delivery to said housing for receiving carrier granules.

15. A developer unit according to claim 14, further comprising a carrier granule conveyor for conveying carrier granules form the recovery device to the carrier granules storage area.

16. A developer unit apparatus according to claim 14, wherein the carrier granule conveyer comprises a flexible auger.

17. A developer unit for developing latent image recorded on an image receiving member to form a developed image, comprising a developer housing defining a chamber for storing developer material comprising carrier granules and toner particles;

a toner dispenser for discharging toner particles;

a housing defining a chamber coupled to said developer housing and said toner dispenser for receiving carrier granules and toner particles;

a mixer, disposed in the chamber of said housing, to mix the carrier granules and toner particles with one another;

means for discharging toner particles and carrier granules from said housing to said developer housing; and a carrier granule storage area for storing said carrier granules prior to delivery to said housing for receiving carrier granules.

18. A developer unit according to claim 17, further comprising a carrier meter for controlling the carrier granules added to the housing for receiving granules and toner particles.

19. A developer unit for developing a latent image recorded on an image receiving member to form a developed image, comprising a developer housing defining a chamber for storing developer material comprising carrier granules and toner particles;

a toner dispenser for discharging toner particles;

a housing defining a chamber coupled to said developer housing and said toner dispenser for receiving carrier granules and toner particles;

a mixer, disposed in the chamber of said housing, to mix the carrier granules and toner particles with one another;

means for discharging toner particles and carrier granules from said housing to said developer housing; and a toner meter for controlling the toner particles added to the housing for receiving carrier granules and toner particles.

20. A developer unit for developing a latent image recorded on an image receiving member to form a developed image, comprising:

a developer housing defining a chamber for storing developer material comprising carrier granules and toner particles;

a toner dispenser for discharging toner particles;

a housing defining a chamber coupled to said developer housing and said toner dispenser for receiving carrier granules and toner particles;

a mixer, disposed in the chamber of said housing, to mix the carrier granules and toner particles with one another;

means for discharging toner particles and carrier granules from said housing to said developer housing; and a mix meter for controlling the mixed carrier granules and toner particles discharged into the developer housing.

21. A developer unit for developing a latent image recorded on an image receiving member to form a developed image, comprising:

a developer housing defining a chamber for storing developer material comprising carrier granules and toner particles;

a toner dispenser for discharging toner particles;

a housing defining a chamber coupled to said developer housing and said toner dispenser for receiving carrier granules and toner particles;

a mixer, disposed in the chamber of said housing, to mix the carrier granules and toner particles with one another;

means for discharging toner particles and carrier granules from said housing to said developer housing; and developer stirrer in the developer housing.

22. A developer unit for developing a latent image recorded on an image receiving member to form a developed image, comprising:

a developer housing defining a chamber for storing developer material comprising carrier granules and toner particles;

a toner dispenser for discharging toner particles;

a housing defining a chamber coupled to said developer housing and said toner dispenser for receiving carrier granules and toner particles;

a mixer, disposed in the chamber of said housing, to mix the carrier granules and toner particles with one another;

means for discharging toner particles and carrier granules from said housing to said developer housing;

a toner meter for controlling the toner particles added to the housing for receiving carrier granules and toner particles;

a carrier meter for controlling the carrier granules added to the housing for receiving carrier granules and toner particles;

a mix meter for controlling the mixed carrier granules and toner particles discharged into the developer housing; and a controller for controlling the interaction of the toner meter, the carrier meter, and the mix meter.

23. A printing machine comprising:

a photoconductive member;

means for recording an electrostatic latent image on said photoconductive member;

a developer unit adapted to develop the latent image recorded in said photoconductive member with the toner particles, said developer unit including a developer housing defining a chamber for storing developer comprising carrier granules and toner particles, a toner dispense for discharging toner particles, and a housing defining a chamber coupled to the developer and the toner dispense for receiving carrier granules and toner particles, a mixer, disposed in the chamber of the housing, to mix the carrier granules and toner particles with one another, and means for discharging toner particles and carrier granules from the housing to the developer housing;

a carrier granules recovery device for recovering used carrier granules from the developed image, said carrier granules to be delivered to said housing for receiving carrier granules; and a carrier granule storage area for storing said carrier granules prior to delivery to said housing for receiving carrier granules and toner particles.

24. A printing machine comprising:

a photoconductive member;

means for recording an electrostatic latent image on said photoconductive member;

a developer unit adapted to develop the latent image recorded in said photoconductive member with the toner particles, said developer unit including a developer housing defining a chamber for storing developer comprising carrier granules and toner particles, a toner dispenser for discharging toner particles, and a housing defining a chamber coupled to the developer housing and the toner dispenser for receiving carrier granules and toner particles, a mixer, disposed in the chamber of the housing, to mix the carrier granules and toner particles with one another, and means for discharging toner particles and carrier granules from the housing to the developer housing; and a carrier granule storage area for storing said carrier granules prior to delivery to said housing for receiving carrier granules and toner particles.

25. A printing machine according to claim 23, further comprising a carrier granule conveyor for conveying carrier granules from the recovery device to the carrier granules storage area.

26. A printing machine apparatus according to claim 25, wherein the carrier granule conveyer comprises a flexible auger.

27. A printing machine comprising:

a photoconductive member;

means for recording an electrostatic latent image on said photoconductive member;

a developer unit adapted to develop the latent image recorded in said photoconductive member with the toner particles, said developer unit including a developer housing defining a chamber for storing developer comprising carrier granules and toner particles, a toner dispenser for discharging toner particles, and a housing defining a chamber coupled to the developer housing and the toner dispenser for receiving carrier granules and toner particles, a mixer, disposed in the chamber of the housing, to mix the carrier granules and toner particles with one another, and means for discharging toner particles and carrier granules from the housing to the developer housing; and a toner meter for controlling the toner particles added to the housing for receiving carrier granules and toner particles.

28. A printing machine comprising:

a photoconductive member;

means for recording an electrostatic latent image on said photoconductive member;

a developer unit adapted to develop the latent image recorded in said photoconductive member with the toner particles, said developer unit including a developer housing defining a chamber for storing developer comprising carrier granules and toner particles, a toner dispenser for discharging toner particles, and a housing defining a chamber coupled to the developer housing and the toner dispenser for receiving carrier granules and toner particles, a mixer, disposed in the chamber of the housing, to mix the carrier granules and toner particles with one another, and means for discharging toner particles and carrier granules from the housing to the developer housing; and a carrier meter for controlling the carrier granules added to the housing for receiving carrier granules and toner particles.

29. A printing machine comprising:

a photoconductive member;

means for recording an electrostatic latent image on said photoconductive member;

a developer unit adapted to developer the latent image recorded in said photoconductive member with the toner particles, said developer unit including a developer housing defining a chamber for storing developer comprising carrier granules and toner particles a toner dispenser for discharging toner particles, and a housing defining a chamber coupled to the developer housing and the toner dispenser for receiving carrier granules and toner particles, a mixer, disposed in the chamber of the housing, to mix the carrier granules and toner particles with one another, and means for discharging toner particles and carrier granules from the housing to the developer housing; and a mix meter for controlling the mixed carrier granules and toner particles discharged into the developer housing.

30. A printing machine comprising:

a photoconductive member;

means for recording an electrostatic latent image on said photoconductive member;

a developer unit adapted to develop the latent image recorded in said photoconductive member with the toner particles, said developer unit including a developer housing defining a chamber for storing developer comprising carrier granules and toner particles, a toner dispenser for discharging toner particles, and a housing defining a chamber coupled to the developer housing and the toner dispenser for receiving carrier granules and toner particles, a mixer, disposed in the chamber of the housing, to mix the carrier granules and toner particles with one another, and means for discharging toner particles and carrier granules from the housing to the developer housing; and a developer stirrer in the developer housing.

31. A printing machine comprising:

a photoconductive member;

means for recording an electrostatic latent image on said photoconductive member;

a developer unit adapted to develop the latent image recorded in said photoconductive member with the toner particles, said developer unit including a developer housing defining a chamber for storing developer comprising carrier granules and toner particles, a toner dispenser for discharging toner particles, and a housing defining a chamber coupled to the developer housing and the toner dispenser for receiving carrier granules and toner particles, a mixer, disposed in the chamber of the housing, to mix the carrier granules and toner particles with one another, and means for discharging toner particles and carrier granules from the housing to the developer housing;

a toner meter for controlling the toner particles added to the housing for receiving carrier granules and toner particles;

a carrier meter for controlling the carrier granules added to the housing for receiving carrier granules and toner particles;

a mix meter for controlling the mixed carrier granules and toner particles discharged into the developer housing; and a controller for controlling the interaction of the toner meter, the carrier meter, and the mix meter.

* * * * *